US006926262B1

(12) United States Patent
Pavlov

(10) Patent No.: US 6,926,262 B1
(45) **Date of Patent: *Aug. 9, 2005**

(54) BARBED TAPE

(76) Inventor: Michael V. Pavlov, 220 Whiteport Rd., Kingston, NY (US) 12401

( * ) Notice: Subject to any disclaimer, the term of this patent is extended or adjusted under 35 U.S.C. 154(b) by 0 days.

This patent is subject to a terminal disclaimer.

(21) Appl. No.: 10/632,394

(22) Filed: Aug. 1, 2003

Related U.S. Application Data

(63) Continuation of application No. 09/642,162, filed on Aug. 18, 2000, now Pat. No. 6,601,830.

(51) Int. Cl.[7] ..... F41H 11/08; B21F 25/00

(52) U.S. Cl. ..... 256/8; 256/2; 140/58; 140/61; 140/66

(58) Field of Search ..... 256/6, 7, 8, 9; 428/582; 140/58, 61, 62, 66

(56) References Cited

U.S. PATENT DOCUMENTS

| | | | |
|---|---|---|---|
| 191,913 | A | 6/1877 | Barnes |
| 293,411 | A | 2/1884 | Brock |
| 386,742 | A | 7/1888 | Grellner |
| 538,401 | A | 4/1895 | Allis |
| 782,670 | A | 2/1905 | Leahy |
| 1,175,433 | A | 4/1916 | Goetsch |
| 2,908,132 | A | 10/1959 | Klemm |
| 2,908,484 | A | 10/1959 | Uhl |
| 3,010,701 | A | 11/1961 | Klemm |
| 3,376,120 | A | 4/1968 | Hiegel |
| 3,455,539 | A | 7/1969 | Loofbourrow |
| 3,463,455 | A | 8/1969 | Meckel et al. |
| 3,480,256 | A | 11/1969 | Simon et al. |
| 3,763,529 | A | 10/1973 | Musgrave |
| 3,911,705 | A | 10/1975 | Voorhes |
| 3,916,958 | A | 11/1975 | Uhl |
| 4,028,925 | A | 6/1977 | Mainiero |
| 4,040,603 | A | 8/1977 | Mainiero |
| 4,045,985 | A | 9/1977 | Musgrave |
| 4,204,415 | A | 5/1980 | Braad et al. |
| RE30,814 | E | 12/1981 | Mainiero |
| 4,503,423 | A | 3/1985 | Mainiero et al. |
| 4,509,726 | A | 4/1985 | Boggs et al. |

(Continued)

FOREIGN PATENT DOCUMENTS

| | | | |
|---|---|---|---|
| EP | 37969 | A1 | 10/1981 |
| FR | 2012041 | A1 * | 3/1970 |

(Continued)

*Primary Examiner*—Daniel P. Stodola
*Assistant Examiner*—Ernesto Garcia
(74) *Attorney, Agent, or Firm*—Schmeiser, Olsen & Watts LLP

(57) ABSTRACT

A barrier structure includes a continuous piece of elongated metal tape. The metal tape includes barbs spaced along an elongate body. Each of the barbs is connected securely to a barb root, and each barb root is connected securely to the elongate body. A first region of the elongate body is adjacent to each barb root, and a second region of the elongate body is adjacent to each first region distal from the barb root. A third region of the elongate body adjacent to each second region distal from the first region extends lengthwise from each second region and meets a corresponding third region that is extending lengthwise away from another second region. Each second region extends transversely and inwardly from the adjacent first region and the adjacent third region.

7 Claims, 4 Drawing Sheets

U.S. PATENT DOCUMENTS

| | | | |
|---|---|---|---|
| 4,666,129 | A | 5/1987 | Dobson |
| 4,680,573 | A | 7/1987 | Ciordinik et al. |
| 4,818,972 | A | 4/1989 | Mainiero et al. |
| 4,844,422 | A | 7/1989 | Major |
| 4,884,425 | A | 12/1989 | Mainiero |
| 4,887,796 | A | 12/1989 | Cano et al. |
| 4,906,975 | A | 3/1990 | Casella et al. |
| 5,109,583 | A | 5/1992 | Pavlov |
| 5,194,847 | A | 3/1993 | Taylor et al. |
| 5,401,002 | A | 3/1995 | Major |
| 5,530,430 | A | 6/1996 | Pavlov |

FOREIGN PATENT DOCUMENTS

| | | | | | |
|---|---|---|---|---|---|
| GB | 2039683 | A | * | 8/1980 | ..... G03B 13/12 |
| GB | 2259722 | A | | 3/1993 | |
| GB | 2337279 | A | | 11/1999 | |
| RU | 2200641 | C1 | * | 3/2003 | ..... B21F 25/00 |

* cited by examiner

BARBED TAPE

CROSS REFERENCE TO RELATED APPLICATION

This application is a continuation of a patent application by Pavlov, entitled "BARBED TAPE", Ser. No. 09/642,162, filed Aug. 18, 2000, now U.S. Pat. No. 6,601,830, which is hereby incorporated herein by reference.

BACKGROUND OF THE INVENTION

1. Technical Field

This invention generally relates to barriers and security fences, and more specifically relates to barbed tape.

2. Background Art

An early form of metal barrier fence was made of barbed wire. This type of barrier has been in use for more than a century, and is typically rather easy to breach. In addition to lacking the visual intimidation common to more modern barbed tape barriers, barbed wire lacks the strength to resist crushing. To defeat its intended purpose, one need only lay some heavy object over the wire strands, thereby providing a walkway over the barrier.

Barbed tape is designed to overcome these deficiencies. It is more visually intimidating than barbed wire, which features short, unimposing barbs. Barbed tape typically employs razor-sharp barb clusters that can be more than two inches in length. The tape is designed to discourage some breach attempts by its appearance alone. Barbed tape barriers also are typically stronger and harder to crush than barbed wire.

A number of variations of barbed tape already exist. Most variations exhibit the same general features-sharp barbs connected to a central metal strip that is curved into a generally helical shape-and introduce various differences designed to improve upon older designs.

One such design is described in U.S. Pat. No. 2,908,484 granted Oct. 13, 1959 to S. Uhl for "BARBED WIRE SPIRAL." This barrier includes a metallic strip wrapped completely around a supporting wire made of spring quality steel so that only the barbs extend from the wire (i.e., there is no flange along the wire between barbs). Disadvantages of this barrier include the relatively unimposing appearance of the smaller barbs, and the narrow center strip. Also, the coils are relatively weak in vertical compression.

The barbed tape barrier disclosed in U.S. Pat. No. 4,509,726 granted Apr. 9, 1985 to W. G. Boggs et al. for "BARRIER" consists of a metal strip wrapped part way around a reinforcing wire. The ends of the metal strip, rather than wrapping completely around the wire, extend away from it to form flanges from which the barbs extend. A key feature of this invention is the reduced width of the flange at the barb root intended to open up the tape in those regions so as to increase the penetration capability of the barbs. One deficiency of this barrier is its loss of strength caused by the reduced flange width. Weaker barriers are easier to breach and barriers that collapse easily are less fit for the purpose of preventing the crossing of the barrier.

DISCLOSURE OF INVENTION

Therefore, there existed a need to provide a barbed tape barrier that is both highly resistant to crushing as well as inexpensive and efficient to manufacture. According to the present invention, a barrier structure includes a continuous piece of elongated metal tape. The metal tape includes barbs spaced along an elongate body. Each of the barbs is connected securely to a barb root, and each barb root is connected securely to the elongate body. A first region of the elongate body is adjacent to each barb root, and a second region of the elongate body is adjacent to each first region distal from the barb root. A third region of the elongate body adjacent to each second region distal from the first region extends lengthwise from each second region and meets a corresponding third region that is extending lengthwise away from another second region. Each second region extends transversely and inwardly from the adjacent first region and the adjacent third region.

Thus, the second regions preferably form cutouts. The cutouts can be placed in a variety of locations and can be a variety of shapes, but it is important that they not be placed immediately adjacent to the barb roots. The cutouts aid in the manufacturing process, as will be explained more fully in a subsequent section. Locating the cutouts away from the root of the barbs lends strength to the structure and allows the barrier to be manufactured with less material than would be needed for weaker structures, thereby lowering the manufacturing cost. Locating the cutouts away from the barb roots also provides for a "second cut" when the barbs pierce the skin of a would-be-intruder.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements.

MODES FOR CARRYING OUT THE INVENTION

Figure 1:
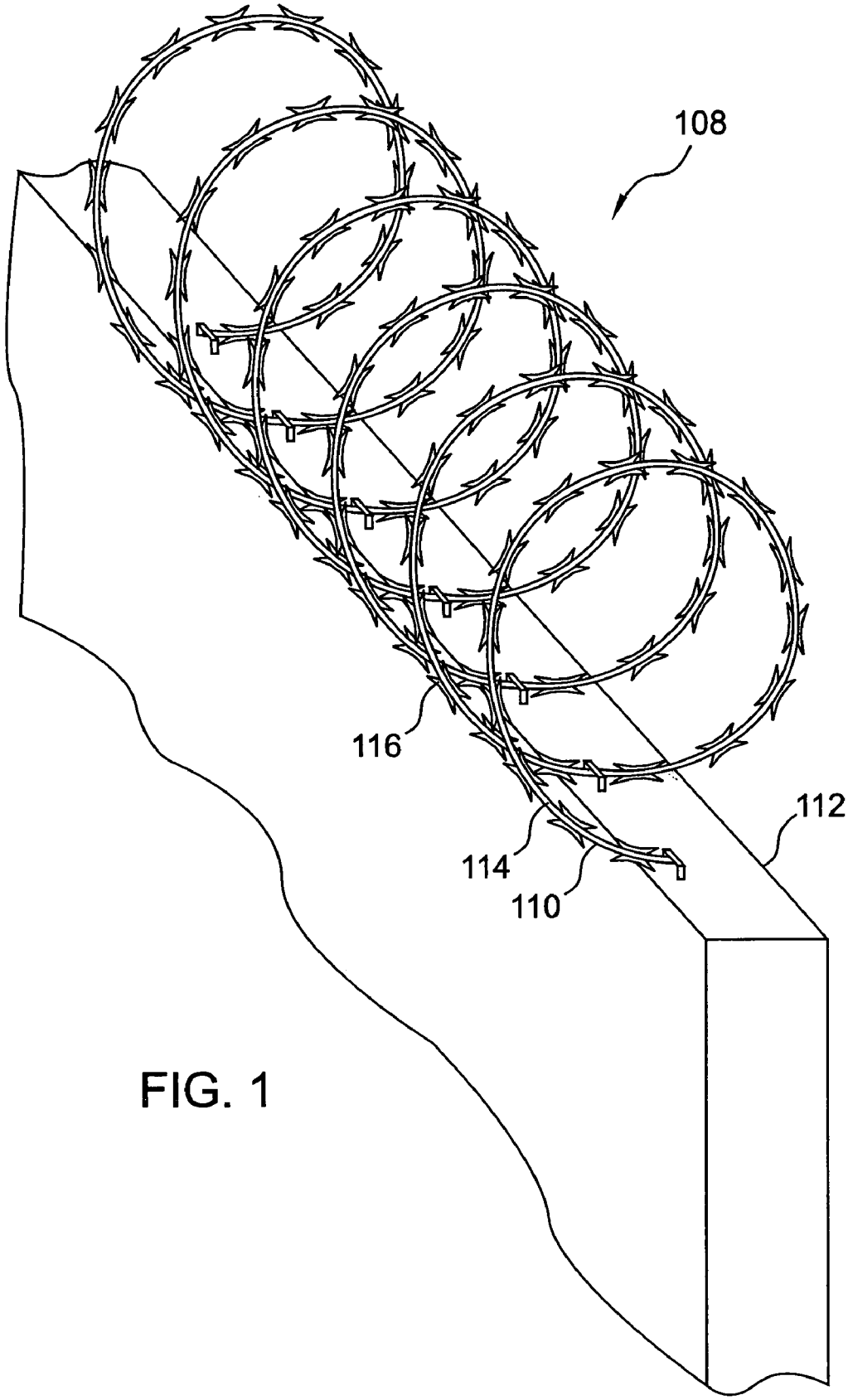
FIG. 1 is an isometric view of a barrier according to the present invention.

Referring to FIG. 1, a barrier 108 includes barbed tape 110 mounted on a wall 112. Barbed tape 110 preferably includes an elongated strip of metal or metal body 114, which has been bent slightly along its longitudinal axis in such a way that the strip substantially forms a helix. Barbs 116 extend from opposing sides of body 114. Preferably the barbs are in clusters of four barbs, with a pair of barbs extending from each side of body 114. Each pair of barbs includes two barbs 116 extending in each opposing longitudinal direction. The helical structure is optimal for preventing intrusions across the barrier because barbs 116 at the top of barrier 108 extend directly toward a would-be intruder. Structural patterns other than helical are also possible. For example, the structure could be a concertina pattern where adjacent loops of helical coils are attached to one another at specified points on the circumference.

The helical structure is also used to facilitate storage and shipment of barbed tape 110. During shipment and storage, the helix can be flattened into a coil, in which configuration the user of tape 110 is somewhat shielded from barbs 116 because many of the barbs 116 are on the inside of the coil where they are less likely to penetrate the skin or clothing of the user. Barbed tape 110 is deployed by stretching it from its coiled form and attaching it to wall 112 or some other structure it is intended to protect, in which configuration barbs 116 are arranged so that some directly confront an approaching person while some lie at various other angles to wall 112 being protected. In this way barbed tape 110 presents an intimidating array of barbs 116 in all directions. The mere appearance of this array may be enough to discourage some breach attempts.

Figure 2:
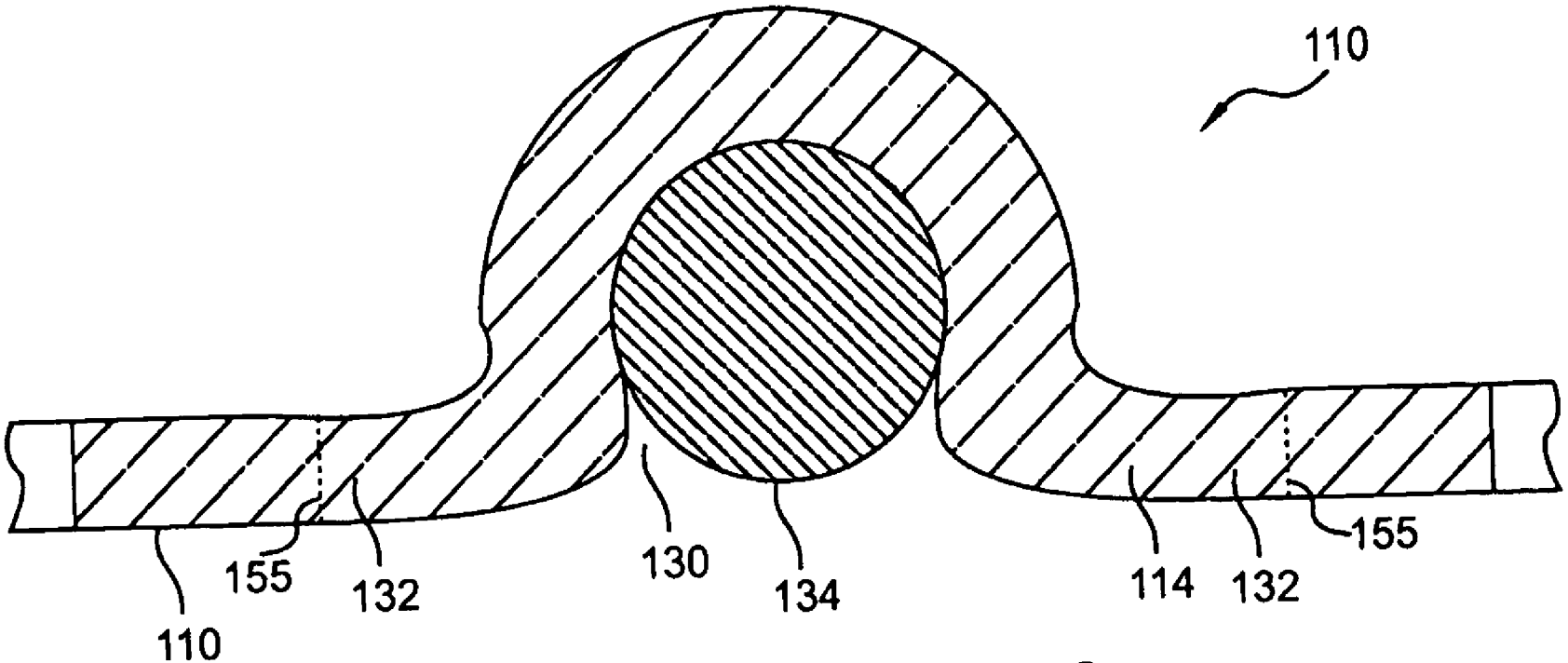
FIG. 2 is a sectional view taken along line 2—2 of FIG. 3.

Referring now to FIG. 2, body 114 preferably defines an elongate channel 130 that runs the entire length of barbed tape 110. Preferably, channel 130 describes an arc. Opposing elongate flanges 132 extend transversely outwardly in substantially the same plane from opposing sides of the opening of channel 130. Channel 130 preferably receives a reinforcing wire 134. Channel 130 is typically about 0.125 inch in depth and roughly the same distance from edge to edge. Typically, the channel extends about 220–240 degrees around wire 134 so as to inclose wire 134 within channel 130 and hold wire 134 in place by pressure from the walls of channel 130.

Wire 134 can be made from a wide range of materials. As an example, stainless steel may be used both for the reinforcing wire 134 and for the barbed tape 110 that forms the rest of the barrier 108. This material is strong, resistant to corrosion, and relatively inexpensive, making it an ideal material for use in an outdoor security barrier. However, many other types of metal could be used for wire 134 and for barbed tape 110.

Figure 3:
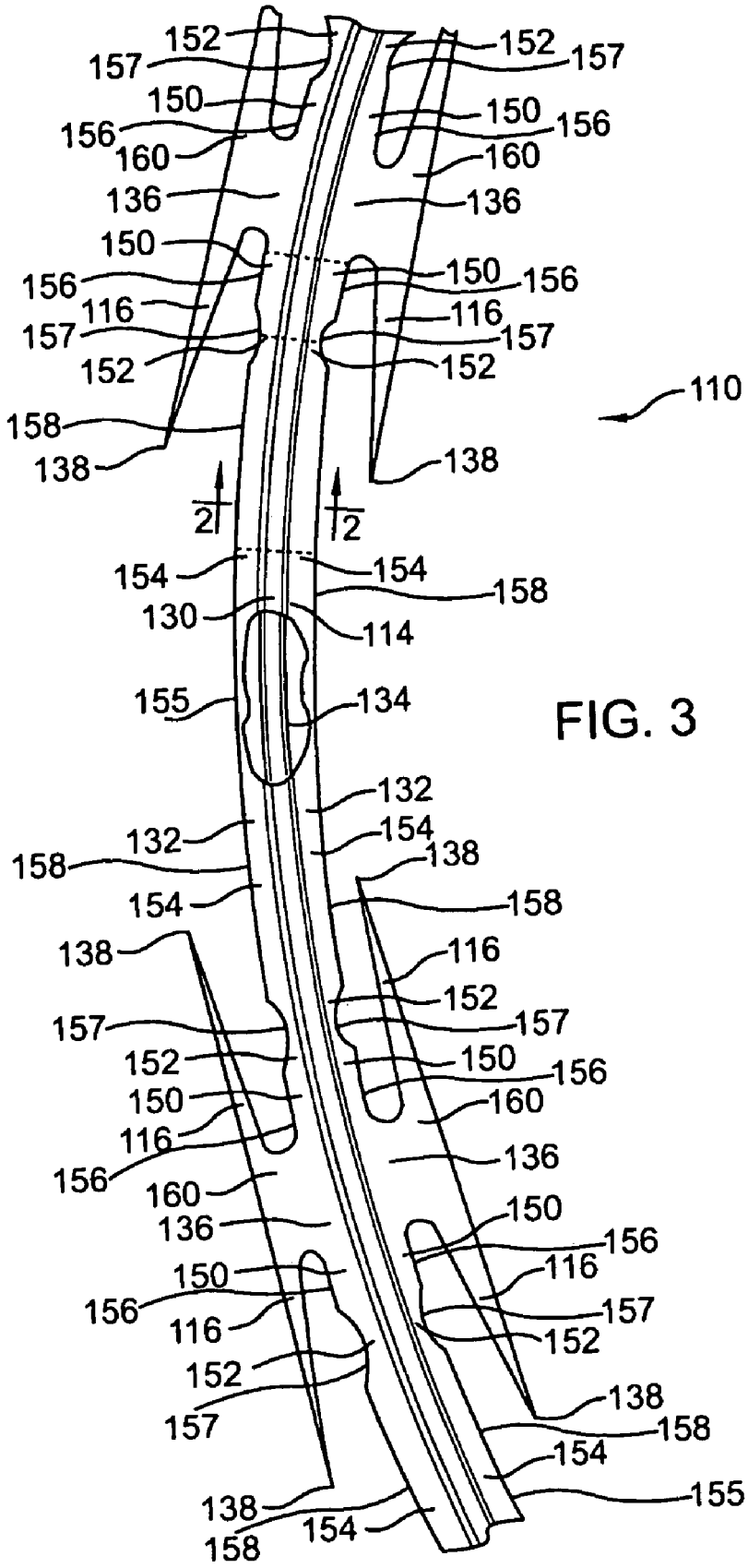
FIG. 3 is a broken away view of a barrier according to the present invention.

Referring now to FIG. 3, flanges 132 typically extend roughly 0.25 inch away from channel 130 and run along the entire length of tape 110. At regular intervals along tape 110, barbs 116 extend transversely from flanges 132. More specifically, a barb root or root portion 136 extends transversely from a flange 132 and preferably branches into a pair of barbs or tapering portions 116 with each barb 116 of the pair of barbs extending in an opposing longitudinal direction. Each barb 116 terminates in a point 138 distal from the barb root 136. Preferably, barbs 116 are formed in clusters of four barbs, with a pair of longitudinally aligned barb roots 136 extending in opposing directions from opposing flanges 132. However, barb roots 136 may be longitudinally offset so that barbs 116 are in clusters of two, rather than four. Also, it is possible that barbs 116 only extend from one side of tape 110, rather than from two opposing sides.

Each barb root 136 is longitudinally bounded by two first regions 150 of flange 132 of body 114 that are each adjacent to the barb root 136. Each first region 150 of flange 132 extends longitudinally to a second region 152. Each second region 152 preferably extends transversely inwardly to form an arcuate cutout in each flange 132. Each second region 152 extends longitudinally from the adjacent first region 150 to an adjacent third region 154 that is distal from first region 150. Thus second region 152 is between first region 150 and third region 154. Third region 154 extends longitudinally from second region 152 to an adjoining third region 154. The adjoining third region 154 extends to another second region 152, which extends to another first region 150, which extends to another barb root 136. This pattern preferably repeats along the length of each side of barbed tape 110. Each flange 132 thus has three repeating regions: first region 150 beginning at barb root 136 and extending away from it; second region 152 that preferably forms an arcuate cutout; and third region 154 extending away from the cutout of second region 152 and running into a corresponding third region 154 that extends to the second region 152 near the next barb root 136. Preferably, the width of all the third regions 154 are the same so that adjoining third regions 154 form a continuous flange region having a substantially constant flange width. In a preferred embodiment, the width of each first region 150 is the same as the width of each third region 154. However, the width of the first regions may differ from the width of the third regions. A typical longitudinal distance along a second region is about 0.25 inch, although other lengths are also possible and may be more preferable for some types of tape.

Flanges 132 have lateral edges 155 extending longitudinally as shown in FIGS. 2 and 3. Lateral edges 155 have first edge portions 156, second edge portions 157, and third edge portions 158 corresponding to portions of edges 155 in first, second, and third regions 150, 152, and 154, respectively. First edge portions 156 are first stamped portions, second edge portions 157 are second stamped portions, and third edge portions 158 are third sheared portions of the lateral edges 155. The terms stamped and sheared are significant for reasons to be described in greater detail below with regard to FIG. 4. As shown in FIG. 3, first edge portions 156 are not continuous relative to second edge portions 157, and second edge portions 157 are not continuous relative to third edge portions 158. For the embodiment of FIG. 3, the relationship of edge portions 156, 157, 158 can be expressed as second edge portions 157 separate first edge portions 156 from third edge portions 158 and form a discontinuity therebetween as shown in FIG. 3.

Barb roots 136 are extensions of flanges 132 and typically have a width of at least 0.25 inch. Each barb root 136 preferably feeds smoothly into the central, shared portion 160 of a barb pair and each barb 116 of the pair then points away from the central portion 160, in a direction opposite to the pair's other barb 116, on a line parallel to the longitudinal axis of barbed tape 110. Barbs 116 may be more than an inch long and taper to very sharp, needle-like points 138 that easily penetrate a person's skin or clothing. As discussed above, barb pairs, in the preferred embodiment, are arranged in barb clusters including two barb pairs each, one barb pair lying on either side of body 114. These barb clusters may be spaced about every three inches along the length of barbed tape 110. This arrangement of barb pairs and barb clusters creates an imposing and effective barrier that quickly stops or deters most would-be breach attempts.

Figure 4:
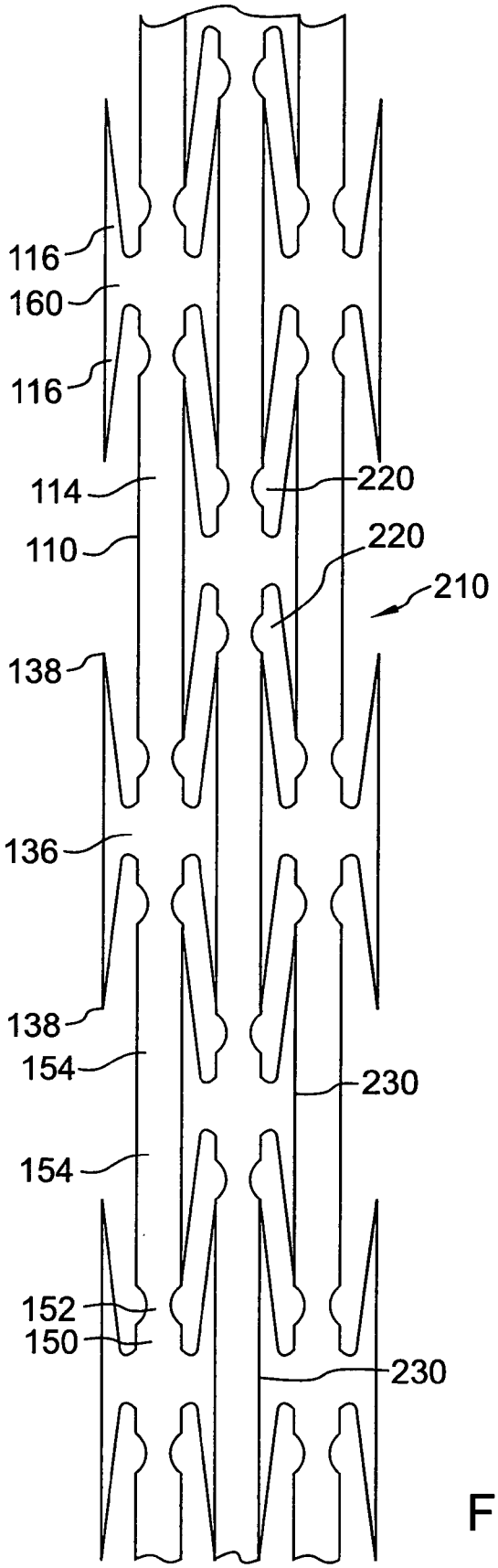
FIG. 4 is a top plan view of a repeating pattern for forming barbed tape according to the present invention.

Referring to FIG. 4, the present invention is manufactured by starting with a sheet 210 of metal such as stainless steel whose width is determined according to the number of barbed tape strips desired for simultaneous manufacture; a typical five strip production run may use a metal blank roughly four inches wide. Preferably, a pattern formed in sheet 210 includes several barbed tapes 110 that are parallel, wherein each barb 116 abuts an adjacent third region 154 of a body 114 so that each barb pair extends between adjacent second regions 152. Thus, the longitudinal distance between second regions 152 (and thus along adjoining third regions 154) is preferably equal to the distance between opposing barb points 138 of barbs 116 of a barb pair. In forming tapes 110 from sheet 210, dies are used to stamp out oblong regions 220 of the metal that will define each first region 150, each second region 152, each barb root 136, and the edge of each barb 116 that faces its body 114. Then, sheet 210 is sheared along each shear line 230 that separates each barb 116 from an abutting third region 154. Preferably, the edge of each shear tool extends from shear line 230 into the cutout formed by each second region 152, thereby completely shearing each tape 110 from adjacent tapes 110 and forming sharp barb points 138. Thus, the cutting tool is able to form a razor-sharp barb point 138 on each barb while making a clean cut between each strip of tape 110. The cutout at each second region 152 prevents the cutting tool from leaving behind a sliver that would require manual removal while dulling the points of the barbs. The cutout at each second region 152 also increases the allowable tolerances of the shearing and stamping tools.

Referring back to FIGS. 1–3, after the strips of barbed tape 110 have been cut out and separated, preferably channels 130 are formed about reinforcing wire 134 and barbed tape 110 is wound into coils. After receiving a shipment of the barbed tape 110, the user stretches the barbed tape into its operational, helical shape along a wall or other structure.

It is an important feature of this invention that the cutouts not be located immediately adjacent to the barb roots 136; therefore the stamping dies are shaped to provide a cutout some distance away from each barb root 136. Having the cutout away from the barb root produces more rigidity in tape 110, and especially increases the rigidity of each barb root 136. Because of the increased rigidity, the width of each third region 154 of body 114 may be decreased, thereby decreasing the amount of material needed.

The strength imparted by these measures allows the invention to withstand the breach attempts that would topple many of the earlier versions of barbed tape barriers. Additionally, the cutout second regions 152 produce a "second cut" when contacted by a would-be-intruder. A first cut is made when barb point 138 initially penetrates the skin, and a second cut is made when the skin contacts the ridge between second region 152 and first region 150.

Alternatively, the barrier structure may be manufactured without reinforcing wire 134. In this embodiment the tape includes a smaller channel because omitting the wire eliminates the need to bend the channel around the wire. Typically, without a reinforcing wire, the channel formed within the metal strip need only describe a 180 degree arc, thus allowing the flanges to be wider while using the same amount of material or equally as wide while using less material. Wider flanges significantly increase the axial strength (due to force directed downwardly on the top of the tape helix) of barbed tape 110 because it increases the polar moment of inertia of the tape. Thus, removing the wire can actually add to the barrier's strength while avoiding an increase in cost, or decrease the cost without producing a corresponding decrease in strength.

While the width of flange 132 in first region 150 and third region 154 may be equal, preferably the width of flange 132 in third region 154 is less than the width of flange 132 in first region 150. In fact, the flange may be eliminated altogether in third region 154 so that the body of the tape in the third region 154 and second region 152 wrap entirely around the reinforcing wire. Thus, in this embodiment, no flange is formed other than first region 150 and the barbs themselves. In this embodiment, the width of the flange in second region 152 and in third region 154 would be equal because there would be no flange in second region 152 or third region 154. However, in such an embodiment, second region 152 still extends transversely and inwardly (i.e., into the material) from the adjacent first region 150 and the adjacent third region 154. Whether the strength of the tape comes from the wider flange or the reinforcing wire, the barrier of this invention is stronger than previous barrier structures.

Second region 152 may be located at any of several distances from barb root 136 and it may form any of several shapes. Also, first region 150 and third region 154 need not be the same width. However, second region 152 forms a cutout and thus has a reduced width relative to first region 150 and third region 154. The cutout of second region 152 should extend transversely inwardly at least about 0.002 inch, and it preferably extends transversely inwardly about 0.06 inch.

While the invention has been particularly shown and described with reference to preferred embodiments thereof, it will be understood by those skilled in the art that various changes in form and details may be made therein without departing from the spirit and scope of the invention. For example, it will be understood that the precise location of the cutout is less important than that it be placed some distance away from the barb root. Additionally, the length of the barbs, the width of the barb roots, the spacing of barb clusters, the dimensions of the cutouts and the channel, and the precise arrangement of barbs, barb pairs, and barb clusters are all capable of being modified to some extent without exceeding the scope of this invention.

What is claimed is:

1. A barrier structure comprising a continuous piece of elongated metal tape, said metal tape comprising:

an elongate body defining a longitudinally extending channel and an elongate flange extending transversely from each side of said channel;

barb roots spaced along said tape and secured to said flanges;

a pair of tapered barbs secured to a barb root, said pair of tapered barbs extending in opposing longitudinal directions, and each of said tapered barbs forming a barb point;

a first region of said elongate body adjacent to the barb root;

a second region of said elongate body adjacent to the first region distal from the adjacent barb root;

a third region of said elongate body adjacent to the second region distal from said first region, the third region extending lengthwise from the second region and meeting a corresponding third region extending lengthwise away from another second region;

wherein:

a width of the flanges in the first region is greater than a width of the flanges in the second region, and wherein a width of the flanges in the third region is greater than the width of the flanges in the second region; and said channel does not receive a reinforcing wire.

2. The structure of claim 1, wherein each second region comprises an arcuate cutout.

3. The structure of claim 1, wherein:

the continuous piece of elongated metal tape has a plurality of first regions, a plurality of second regions, and a plurality of third regions; and a distance between the barb points of said pair of barbs is the same as a distance between adjacent ones of said second regions of said tape.

4. A barrier structure comprising a continuous piece of elongated metal tape, said metal tape comprising:

an elongate body defining a longitudinally extending channel and an elongate flange extending transversely from each side of said channel;

barb roots spaced along said tape and secured to said flanges;

a pair of tapered barbs secured to a barb root, said pair of tapered barbs extending in opposing longitudinal directions, and each of said tapered barbs forming a barb point;

a first region of said elongate body adjacent to the barb root;

a second region of said elongate body adjacent to the first region distal from the adjacent barb root;

a third region of said elongate body adjacent to the second region distal from said first region, the third region extending lengthwise from the second region and meeting a corresponding third region extending lengthwise away from another second region;

wherein:

the second region extends inwardly from the first region to the third region;

the width of the flanges in the first region is greater than the width of the flanges in each third region; and said channel describes an arc extending between the flanges, the arc extending less or equal to approximately 180°.

5. The structure of claim 4, wherein a width of each of the flanges in each first region is greater than a width of each of the flanges in each second region, and wherein a width of each of the flanges in each third region is greater than a width of each of the flanges in each second region.

6. The structure of claim 4, wherein a width of each of the flanges in each second region is equal to a width of each of the flanges in each third region.

7. The structure of claim 4, wherein:

the continuous piece of elongated metal tape has a plurality of first regions, a plurality of second regions, and a plurality of third regions; and a distance between the barb points of said pair of barbs is approximately the same as the distance between adjacent ones of said second regions of said tape.

* * * * *